US006899386B2

(12) United States Patent
Anton

(10) Patent No.: US 6,899,386 B2
(45) Date of Patent: May 31, 2005

(54) FOLDING CHAIR TRAY ASSEMBLY

(76) Inventor: T. J. Louis Anton, 719 Northeast St., Joseph, OR (US) 97846

( * ) Notice: Subject to any disclaimer, the term of this patent is extended or adjusted under 35 U.S.C. 154(b) by 55 days.

(21) Appl. No.: 10/680,613

(22) Filed: Oct. 6, 2003

(65) Prior Publication Data

US 2005/0073181 A1 Apr. 7, 2005

(51) Int. Cl.[7] ..... A47B 39/00
(52) U.S. Cl. ..... 297/174 R; 297/170
(58) Field of Search ..... 297/171, 173, 297/174 R, 148, 153, 135, 170; 108/50.11; 403/345; 248/223.41, 220.21, 219.3, 219.1, 248/121

(56) References Cited

U.S. PATENT DOCUMENTS

| | | | | |
|---|---|---|---|---|
| 2,447,391 A | * | 8/1948 | Brandes et al. | 297/45 |
| 2,925,125 A | | 2/1960 | Curry | |
| 3,166,354 A | | 1/1965 | Sorensen | |
| 3,328,078 A | | 6/1967 | Whitley | |
| 3,367,714 A | | 2/1968 | Stone | |
| 3,494,661 A | | 2/1970 | Leyburn | |
| 3,586,367 A | | 6/1971 | Cincotta | |
| 4,174,866 A | | 11/1979 | Rhyan | |
| 4,288,122 A | | 9/1981 | Meek | |
| 4,300,798 A | | 11/1981 | Musgrove | |
| 4,566,732 A | * | 1/1986 | Ostergaard et al. | 297/174 R |
| 4,591,206 A | | 5/1986 | Pribble | |
| 4,779,884 A | | 10/1988 | Minati | |
| 4,861,102 A | | 8/1989 | Fuller | |
| 5,474,270 A | * | 12/1995 | Rixen et al. | 248/230.5 |
| 5,644,994 A | | 7/1997 | Liang | |
| 5,865,124 A | * | 2/1999 | Wroe | 108/26 |
| 6,375,257 B1 | | 4/2002 | Wooding | |
| 6,685,264 B2 | * | 2/2004 | Mullen et al. | 297/173 |

* cited by examiner

*Primary Examiner*—Milton Nelson, Jr.
(74) *Attorney, Agent, or Firm*—Stephen M. Nipper; Dykas, Shaver & Nipper

(57) ABSTRACT

A removable tabletop assembly for use with a folding chair convertible from a folded mode into an unfolded mode. The chair having a frame, including a plurality of interconnected frame tubes, the tabletop assembly comprising a platform with connectors extending there from configured to connect with a pair of chair bracket assemblies that are attached to the frame tubes of the chair. Upon removal of the platform, the chair can be converted between the folded mode and the unfolded mode without removal of the chair bracket assemblies.

10 Claims, 1 Drawing Sheet

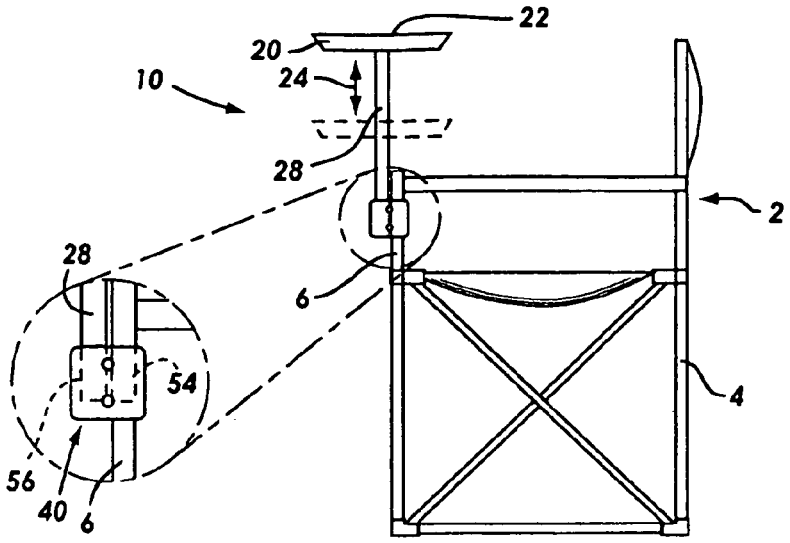
Fig. 1
Fig. 2
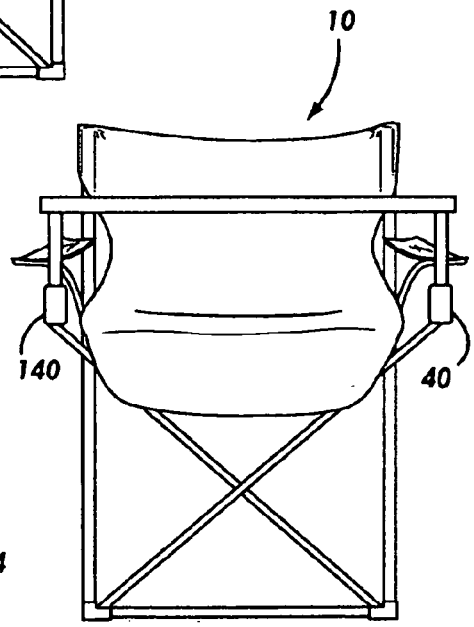
Fig. 4
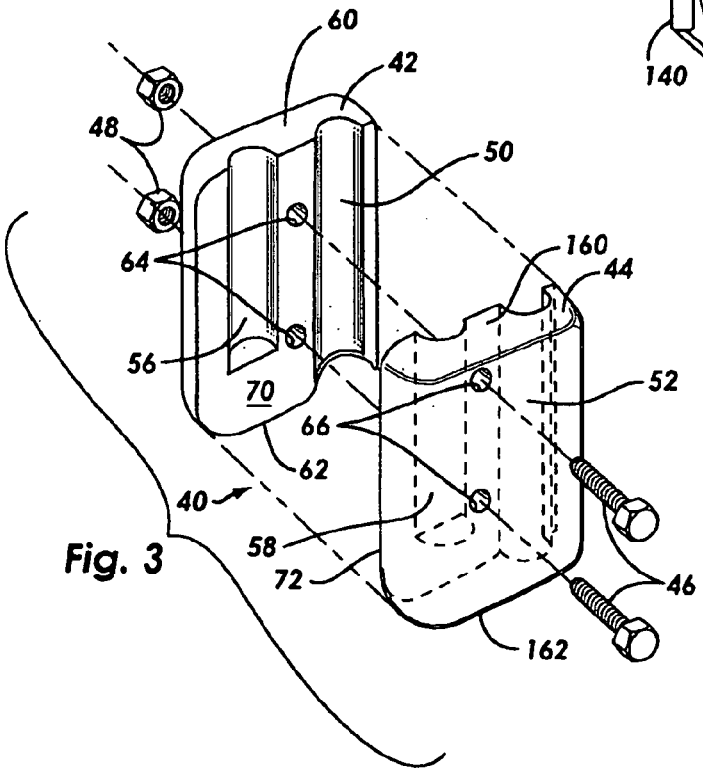
Fig. 3
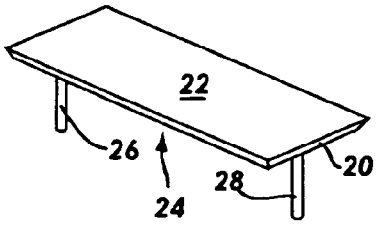
Fig. 5

FOLDING CHAIR TRAY ASSEMBLY

BACKGROUND OF THE INVENTION

1. Field of the Invention

The present invention generally relates to furniture, and more particularly relates to tabletop assemblies for outdoor folding chairs.

2. Background Information

Common today are a style of outdoor folding chairs comprising a plurality of aluminum tubing connected together at pivots, covered with a canvas like material comprising the seat, seatback and or arms. These chairs typically able to fold down and be converted into a generally cylindrical folded mode from an in-use, unfolded mode. Being in the cylindrical folded mode, such chairs are typically able to be stored in a generally tubular carrying bag having a shoulder strap for allowing the chair to be conveniently transported and stored.

While such chairs can be used with a separate table (such as a picnic table or folding "card" table) or other generally planar surface, typically such chairs are used in locations where there are no such tables (for instance, camp sites, sporting events, etc.). What is needed is an add-on tabletop platform that allows a user to retrofit a standard folding chair to accept said tabletop platform. The present invention solves these needs. Such a tabletop platform is useful for a plurality of reasons, including, but not limited to, providing an eating surface, providing gun rest surface, providing a game playing surface, etc.

Additional objects, advantages and novel features of the invention will be set forth in part in the description which follows and in part will become apparent to those skilled in the art upon examination of the following or may be learned by practice of the invention. The objects and advantages of the invention may be realized and attained by means of the instrumentalities and combinations particularly pointed out in the appended claims.

SUMMARY OF THE INVENTION

One embodiment of the present invention is a removable tabletop assembly for use with a folding chair. This folding chair configured to be convertible from a folded mode to an unfolded mode. This folding chair having a frame comprising a plurality of interconnected frame tubes. The removable tabletop assembly itself comprising a platform and a pair of chair bracket assemblies.

The platform having a topside and a bottom side. At least two connectors extend generally perpendicularly away from the bottom side. Each of these connectors configured for attachment to a chair bracket assembly.

The chair bracket assemblies configured for attaching the platform to the chair. Each chair bracket assembly configured for attachment to at least one chair frame tube and one of the platform connectors. Each chair bracket assembly comprising a first bracket configured for attachment to a second bracket. The first bracket defining a first channel therein and the second bracket defining a second channel therein. The first and second channels configured for adjacent orientation, thereby defining a joint channel there between. This joint channel for receiving therein the chair frame tube upon which the present invention is attached. Such receipt, through use of one or more fasteners, being preferably frictional, thereby holding said bracket assembly in place upon said tube. The chair bracket assembly further comprising at least one fastener for fixedly fastening the first and second brackets together upon the chair frame tube. Each of the chair brackets further comprising a connector receiver for receipt of and/or attachment to one of the platforms connectors.

Thus, in use, the chair bracket assemblies would be fixedly attached to the chair, thereby permitting the removable attachment of the platform to the chair. It is preferred that the chair bracket assemblies be attached in such a manner that the chair can be converted between the folded and unfolded mode without removal of the chair bracket assemblies.

Further, the purpose of the foregoing Abstract of the Disclosure is to enable the United States Patent and Trademark Office and the public generally, and especially the scientists, engineers, and practitioners in the art who are not familiar with patent or legal terms or phraseology, to determine quickly from a cursory inspection the nature and essence of the technical disclosure of the application. The Abstract is neither intended to define the invention of the application, which is measure by the claims, nor is it intended to be limiting as to the scope of the invention in any way.

Still other objects and advantages of the present invention will become readily apparent to those skilled in this art from the following detailed description wherein I have shown and described only the preferred embodiment of the invention, simply by way of illustration of the best mode contemplated by carrying out my invention. As will be realized, the invention is capable of modification in various obvious respects all without departing from the invention. Accordingly, the drawings and description of the preferred embodiment are to be regarded as illustrative in nature, and not as restrictive in nature.

BRIEF DESCRIPTION OF THE DRAWINGS

FIG. 1 is a side, environmental view of one embodiment of the present invention.

FIG. 2 is a partial, side view of the embodiment of FIG. 1.

FIG. 3 is an exploded, perspective view of a second embodiment of the present invention.

FIG. 4 is a first side view of a third embodiment of the present invention.

FIG. 5 is a perspective view of one embodiment of a platform or tabletop of the present invention.

DESCRIPTION OF THE PREFERRED EMBODIMENTS

While the invention is susceptible of various modifications and alternative constructions, certain illustrated embodiments thereof have been shown in the drawings and will be described below in detail. It should be understood, however, that there is no intention to limit the invention to the specific form disclosed, but, on the contrary, the invention is to cover all modifications, alternative constructions, and equivalents falling within the spirit and scope of the invention as defined in the claims.

Referring to FIGS. 1 and 2, shown is one embodiment of the invented removable tabletop assembly 10 for a folding chair 2. The preferred folding chair being one of the compact models typically seen on the market today, however other makes and models of chairs are likewise envisioned within this disclosure. These current compact models typically having a frame 4 comprising a number of frame tubes 6 joined at joints (pivots) that allow the chair to be converted from a folded, generally tubular mode to an unfolded, in use mode. While in the folded mode, such chairs are typically stored within a bag or other storage container bearing at least one strap for allowing said chair to be easily transported from one location to the next.

The present invention comprises a platform 20 and one or more chair bracket assemblies 40, 140. The preferred platform 20 (other platform embodiments are shown in FIGS. 4 and 5) comprising a generally planar body, having extending therefrom one or more connectors 26, 28 for allowing the platform 20 to be connected to the chair 4 via the chair bracket assembly or assemblies 26, 28. This platform having a topside 22 and a bottom side 24. Preferably, the connectors 26, 28 extending therefrom said bottom side 24 generally perpendicular to said bottom side. The purpose of the platform 20 being to serve as a tabletop for the user of the chair while eating, playing games, firing a firearm, etc.

The preferred embodiment comprising the utilization of two connectors extending from said platform, however other numbers of connectors are also envisioned. The preferred connectors comprising lengths of tubing (such as metal, wood, plastic or other material tubing) fixed to the bottom side of the platform. The platform could be made of metal, wood, plastic or other material. The platform and the connectors could be integrally formed of the same material or could comprise two different materials fused or otherwise attached together.

As can be shown in FIG. 1, it is envisioned that the connection between the chair bracket assembly and the platform 20 could be made in a telescoping manner through use of a telescoping assembly 30 so that the platform 20 can extend upward or downward, being adjusted and/or locked therein by the user at the preferred height. The preferred telescoping assembly being telescoping connector poles.

As can be seen from the drawing, the chair bracket assembly 40 (140) is configured to attach to the frame tube 6. This frame attachment being a rigid attachment that preferably remains on the chair when the chair is stored and/or otherwise not in use. As such, the only component that is, by default, fixed on the chair is the chair arm assembly 40 (140), which is non-intrusive into the use of the chair should the user prefer not to use platform 20. Platform 20 preferably being able to be releaseably connected to the chair arm bracket 40 thereby allowing the platform 20 to be connected to the frame of the chair.

Referring specifically to the embodiment of FIG. 2, the chair bracket assembly 40 further comprising a joint channel 54 extending through the chair bracket assembly 40 for receiving therein the frame tube 6. Likewise is shown the connector receiver 56 for receiving the connector 28 of the platform 20. Other means, methods and manufactures of chair bracket assemblies and brackets are likewise envisioned.

Referring now to FIG. 3, shown is one embodiment of a chair bracket assembly 40 of the present invention. This chair bracket assembly 40 comprising a first bracket 42 and a second bracket 44. These two brackets able to cooperate with one another and be attached to the frame tube 6 of a folding chair 2 through use of one or more fasteners 46, 48. Alternatively, the present invention could comprise a single bracket rather than first and second brackets which cooperate with one another.

The preferred embodiment of the chair bracket assembly 40 of the present invention is shown in FIG. 3. The first bracket 42 having an inside face 70 and the second bracket 44 having an inside face 72. Within the inside face 70 of the first bracket 42 is defined a first channel 50 there through for receiving said frame tube 6 therein, and is preferably defined a connector receiver channel 56. The inside face 72 of the second bracket 44 likewise defining therein a second channel 52 and a connector receiver 58. It is preferred that all channels comprise semi-circular slots defined therein, the first channel slots extending completely through the inside faces, whereas the connector receiver channels only partially extending there through the inside faces. Other sizes, shapes, and orientations of channels within this invention are envisioned.

The first and second brackets configured for joining together so that the first and second channels thereby define a joint channel 54 and the connector receivers 56, 58 join together to form a connector channel 59. This connector channel 59 for receiving therein the connector 26, 28 of the platform 20. While it is envisioned that a releasable slip or friction fit will be utilized for this attachment, other attachment means could likewise be utilized, including but not limited to snap fits, adhesives, fasteners, etc.

While it is preferred that half of the channels be located within the first bracket and half within the second bracket, it is expressly envisioned that the entire channel could be in one of the brackets. Likewise, it is envisioned that one bracket rather than a pair of clam shell brackets could be provided, this solitary bracket configured for attachment to the frame tube and having a connector receiver channel 56 therein.

The first bracket 42 having a top 60 and a bottom 62. The second bracket 44 having a top 160 and a bottom 162. In this embodiment, a number of fastener holes 64, 66 extend through both first and second brackets for utilization with the fasteners 46, 48.

Referring now to FIG. 4, shown is one embodiment of the present invention 10 shown installed on a chair 2. The folding chair 2 having the removable tabletop assembly 10 installed thereon. The figure showing the platform 20 having a top side 22 and a bottom side 24. A pair of connectors 26, 28 extending therefrom the bottom side 24 and cooperating with first and second chair bracket assemblies 42, 44.

Referring now to FIG. 5, shown is one embodiment of the tabletop platform 20 of the present invention. This tabletop platform 20 having a top side 22, a bottom side 24, and a pair of connectors 26, 28 extending therefrom. Alternatively, the table top could be configured to allow the distance between the connectors/posts to be adjustable, thereby allowing the present invention to be utilized with chairs of differing widths.

While there is shown and described the present preferred embodiment of the invention, it is to be distinctly understood that this invention is not limited thereto but may be variously embodied to practice within the scope of the following claims. From the foregoing description, it will be apparent that various changes may be made without departing from the spirit and scope of the invention as defined by the following claims.

I claim:

1. A removable table top assembly for use with a folding chair convertible from a folded mode to an unfolded mode, said folding chair having a frame comprising a plurality of interconnected frame tubes, the table top assembly comprising:

a platform having a top side and a bottom side, at least two connectors extending generally perpendicularly from said bottom side, each of said connectors configured for attachment to a chair bracket assembly; and a pair of chair bracket assemblies configured for attaching said platform to said chair, each chair bracket assembly configured for attachment to at least one chair frame tube and one of said platform connectors, each chair bracket assembly comprising a joint channel for connecting to said chair frame tube, each of said chair bracket assemblies further comprising a connector receiver for attaching thereto one of said platform connectors;

wherein each chair bracket assembly comprising a first bracket configured for attachment to a second bracket, wherein said first bracket defining a first channel therein, said second bracket defining a second channel therein, said first and second channels configured for adjacent orientation thereby defining said joint channel there-between;

wherein said chair can be converted between said folded mode and said unfolded mode without removal of said chair bracket assemblies.

2. The removable table top assembly of claim 1, wherein said platform remains attached to one of said bracket assemblies when said chair is within said folded mode.

3. The removable table top assembly of claim 1, wherein said connectors further comprise telescoping portions.

4. The removable table top assembly of claim 1, wherein said chair bracket assembly further comprising at least one fastener for fixedly fastening said first and second brackets together upon said chair frame tube.

5. A removable table top assembly for use with a folding chair convertible from a folded mode to an unfolded mode, said folding chair having a frame comprising a plurality of interconnected frame tubes, the table top assembly comprising:

a platform having a top side and a bottom side, at least two connectors extending generally perpendicularly from said bottom side, each of said connectors configured for attachment to a chair bracket assembly; and a pair of chair bracket assemblies configured for attaching said platform to said chair, each chair bracket assembly configured for attachment to at least one chair frame tube and one of said connectors, each chair bracket assembly comprising a first bracket configured for attachment to a second bracket, said first bracket defining a first channel therein, said second bracket defining a second channel therein, said first and second channels configured for adjacent orientation thereby defining a joint channel there-between, said joint channel for receiving therein said chair frame tube, said chair bracket assembly further comprising at least one fastener for fixedly fastening said first and second brackets together upon said chair frame tube, each of said chair brackets further comprising a connector receiver for attaching thereto one of said platform connectors;

wherein said chair can be converted between said folded mode and said unfolded mode without removal of said chair bracket assemblies.

6. The removable table top assembly of claim 5, wherein said platform remains attached to one of said bracket assemblies when said chair is within said folded mode.

7. The removable table top assembly of claim 5, wherein said connectors further comprise telescoping portions.

8. A removable table top assembly for use with a folding chair convertible from a folded mode to an unfolded mode, said folding chair having a frame comprising a plurality of interconnected frame tubes, the table top assembly comprising:

a platform having a top side and a bottom side, at least two posts extending generally perpendicularly from said bottom side, each of said posts configured for attachment to a chair bracket assembly; and a pair of chair bracket assemblies configured for attaching said platform to said chair, each chair bracket assembly configured for attachment to at least one chair frame tube and one of said platform posts, each chair bracket assembly comprising a first bracket configured for attachment to a second bracket, said first bracket defining a first channel therein, said second bracket defining a second channel therein, said first and second channels configured for adjacent orientation thereby defining a joint channel there-between, said joint channel for receiving therein said chair frame tube, said chair bracket assembly further comprising at least one fastener for fixedly fastening said first and second brackets together upon said chair frame tube, each of said chair brackets further comprising a post receiver for receiving therein one of said posts;

wherein said chair can be converted between said folded mode and said unfolded mode without removal of said chair bracket assemblies.

9. The removable table top assembly of claim 8, wherein said platform remains attached to one of said bracket assemblies when said chair is within said folded mode.

10. The removable table top assembly of claim 8, wherein said posts further comprise telescoping portions.

* * * * *